US007039981B2

(12) United States Patent
Lychwick

(10) Patent No.: US 7,039,981 B2
(45) Date of Patent: May 9, 2006

(54) ORBITAL ERASER AND SCRATCH-OFF CARD REMOVER

(76) Inventor: Kurt P. Lychwick, 7740 W. Forest Home Ave., Greenfield, WI (US) 53220

( * ) Notice: Subject to any disclaimer, the term of this patent is extended or adjusted under 35 U.S.C. 154(b) by 58 days.

(21) Appl. No.: 10/358,963

(22) Filed: Feb. 5, 2003

(65) Prior Publication Data

US 2004/0148719 A1 Aug. 5, 2004

(51) Int. Cl.
*B43L 19/00* (2006.01)

(52) U.S. Cl. ..... 15/3.53; 15/26

(58) Field of Classification Search ..... 15/3.53, 15/26, 429, 424, 425, 427; 401/117; 81/440, 81/442

See application file for complete search history.

(56) References Cited

U.S. PATENT DOCUMENTS 834,783 A * 10/1906 Weguelin ..... 15/3.53
933,299 A * 9/1909 Gardner ..... 15/3.53
1,710,080 A * 4/1929 Shenkan ..... 15/3.53
2,074,255 A * 3/1937 Dodson ..... 15/3.53
2,564,604 A * 8/1951 Rene ..... 15/3.53
4,037,283 A * 7/1977 Moisiuk ..... 15/4
4,817,226 A * 4/1989 Kuo ..... 15/3.53
5,311,630 A * 5/1994 Nakamura et al. ..... 15/3.53
6,454,479 B1 * 9/2002 Lychwick ..... 401/92
6,702,495 B1 * 3/2004 Lychwick ..... 401/92

* cited by examiner

*Primary Examiner*—Gary K. Graham

(57) ABSTRACT

An orbital remover including a body assembly and a tip drive assembly. The body assembly includes a main spring. The tip drive assembly includes a tip holder, a bearing guide having a convoluted race formed on an inner surface, a bearing spring, and at least two ball bearings. The ball bearings are housed in the tip drive assembly between the bearing spring and the bearing guide within the convoluted race formed in the body assembly, and the depression of the body assembly in a vertical movement actuates the ball bearings within the convoluted race, thereby rotating a tip received in the tip holder in an orbital movement. The main spring provides resistance for and returns the tip drive assembly to a starting position after the body assembly is vertically depressed.

8 Claims, 12 Drawing Sheets

ORBITAL ERASER AND SCRATCH-OFF CARD REMOVER

BACKGROUND OF THE INVENTION

1. Field of the Invention

This invention is in the field of marking score spaces and scratch-off cards. In particular, the present invention relates to a scratch-off card remover used to erase ink and/or lead or remove surfaces from score sheets/lottery cards.

2. Description of the Related Art

In erasing score spaces on a scholastic test or on a lottery card, an eraser is typically used to erase the surface or score spaces. Unfortunately, when users erase a score space with an eraser, there is a tendency to erase beyond the boundaries of a particular space so that the spaces are often misread because the user mistakenly erases outside of the boundary. Another issue is the amount of time required to completely and accurately erase score spaces and/or scratch off the surface of lottery card spaces.

Finally, when a user scratches off a lottery card, the scratched off wax surface from the card is left behind. It is typically the case that a user must scratch off several areas on a single card, and may even scratch off numerous cards at once. Accordingly, there is a need for an orbital eraser and scratch-off card remover that noticeably reduces the amount of waste that is created by scratching off each of the spaces on the card.

Accordingly, there is a need for an orbital scratch-off card remover used to erase score spaces on a scholastic test or scratch off score spaces on a lottery card without making a horizontal motion across the writing surface. There is also a need for an efficient orbital eraser that can be used by draftspersons and others in the architectural field to efficiently and accurately erase markings on drawings. Furthermore, there is a need for an orbital scratch-off remover that can be economically manufactured.

SUMMARY OF THE INVENTION

One object of this invention is to provide an orbital remover including a body assembly and a tip drive assembly. The body assembly includes a main spring. The tip drive assembly includes a tip holder, a bearing guide having a convoluted race formed on an inner surface of the body assembly, a bearing spring, and at least two ball bearings. The ball bearings are housed in the tip drive assembly between the bearing spring and the bearing guide within the convoluted race formed in the body assembly. The depression of the body assembly in a vertical movement actuates the ball bearings within the convoluted race, thereby rotating a tip received in the tip holder in an orbital movement. The main spring provides resistance for and returns the tip drive assembly to a starting position after the body assembly is vertically depressed.

Another object of this invention is to provide an orbital remover including a body assembly and a tip drive assembly. The body assembly includes a main spring. The tip drive assembly includes a tip holder, a bearing guide having a convoluted race formed on an inner surface of the body assembly, a bearing spring, and at least two ball bearings. The ball bearings are housed in the tip drive assembly between the bearing spring and the bearing guide within the convoluted race formed in the body assembly, and the depression of the body assembly in a vertical movement actuates the ball bearings within the convoluted race, thereby rotating a tip received in the tip holder in an orbital movement.

Yet another object of this invention is to provide an orbital remover including a body assembly and a tip drive assembly. The body assembly includes a main spring. The tip drive assembly includes a bearing guide having a convoluted race formed on an inner surface of the body assembly, a bearing spring, and at least two ball bearings. The ball bearings are housed in the tip drive assembly between the bearing spring and the bearing guide within the convoluted race formed in the body assembly, and the depression of the body assembly in a vertical movement actuates the ball bearings within the convoluted race, thereby rotating a tip in an orbital movement.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Orbital Marking Pencil

Figure 1:
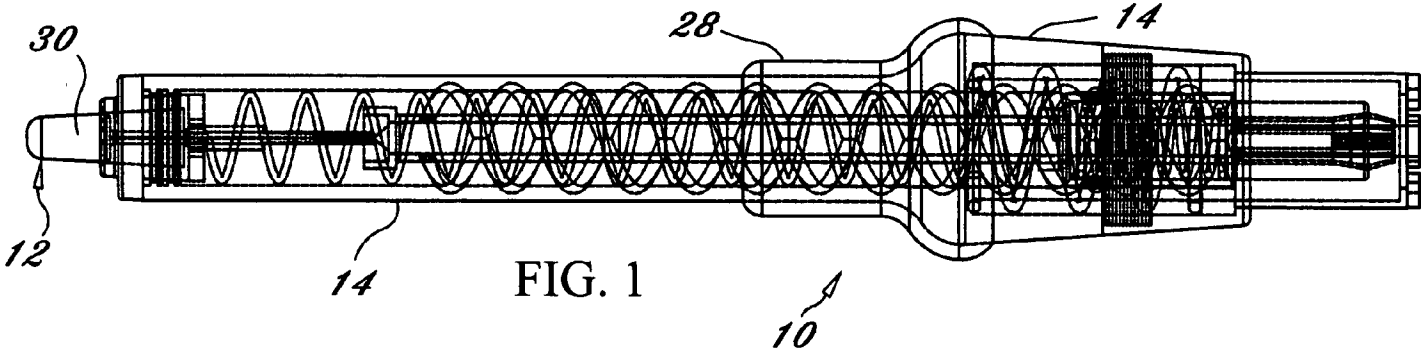
FIG. 1 is a cross-sectional view of an orbital marking pencil according to the preferred embodiment of the present invention.
Figure 2:
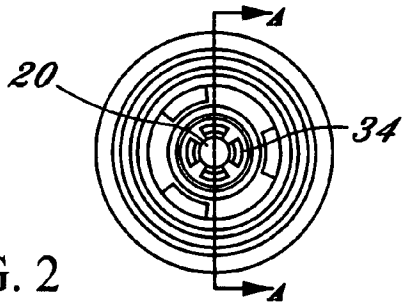
FIG. 2 is an end view of an orbital marking pencil according to the preferred embodiment of the present invention.
Figure 3:
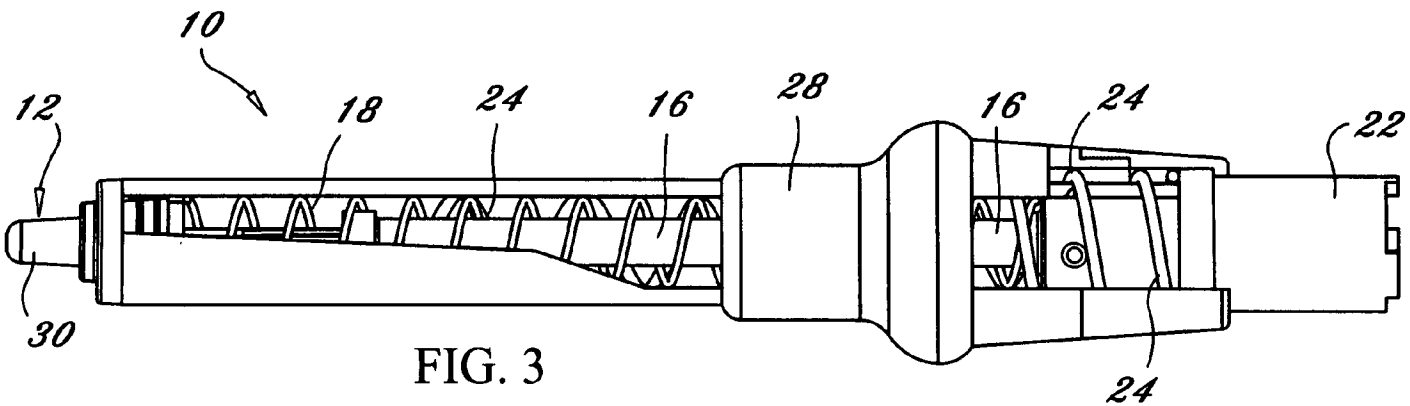
FIG. 3 is a perspective view of an orbital marking pencil according to the preferred embodiment of the present invention.
Figure 4:
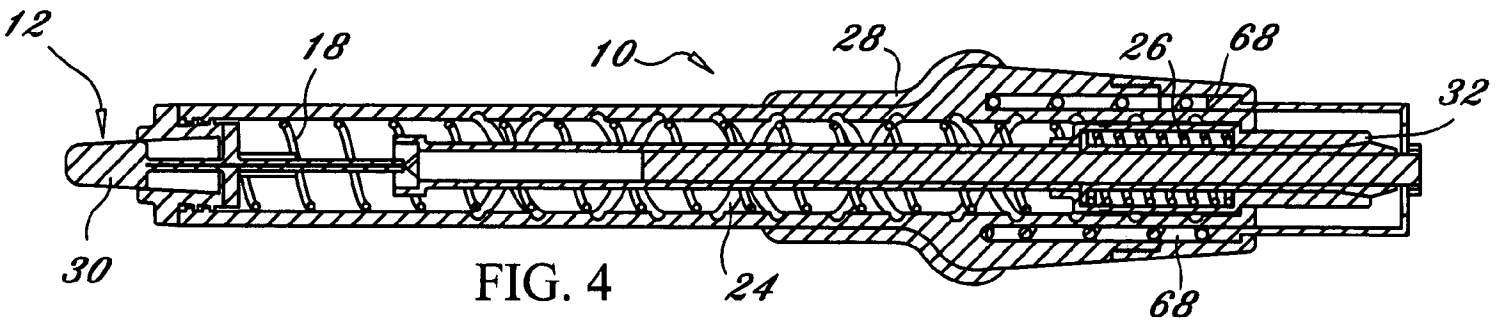
FIG. 4 is a cross-sectional view along line A—A of FIG. 2 of an orbital marking pencil according to the preferred embodiment of the present invention.
Figure 5:
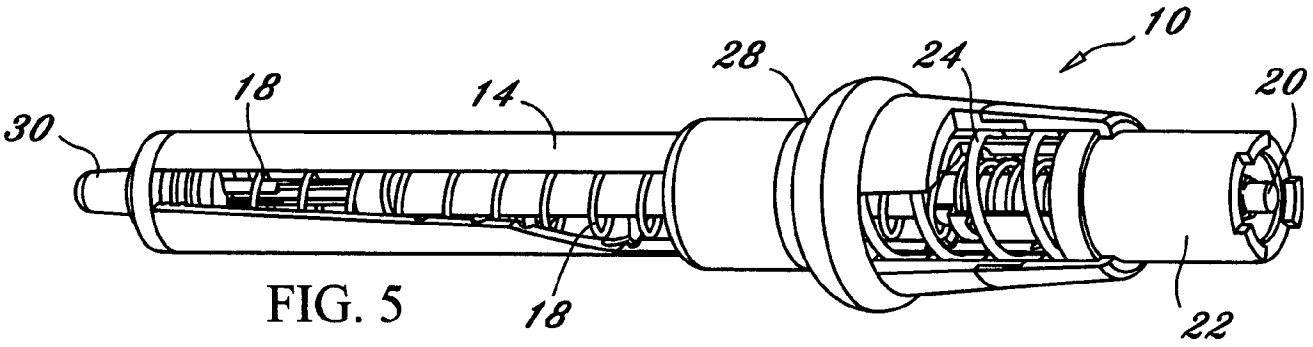
FIG. 5 is a perspective view of an orbital marking pencil according to the preferred embodiment of the present invention.
Figure 6:
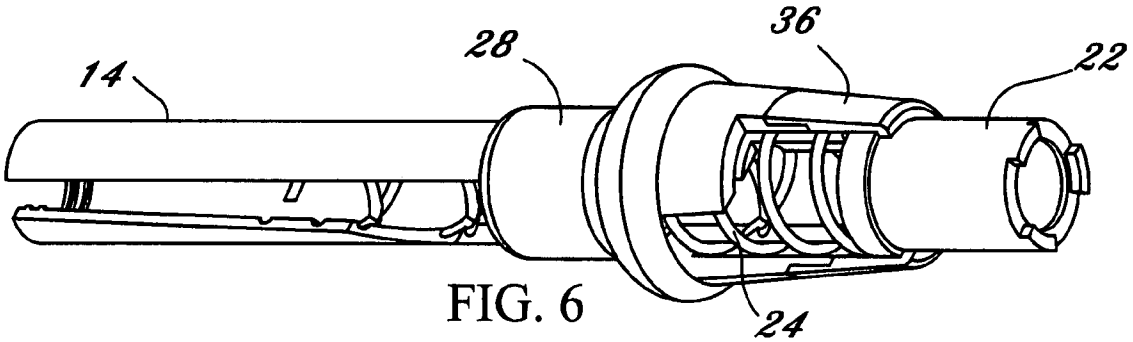
FIG. 6 is a perspective view of a body assembly of an orbital marking pencil according to the preferred embodiment of the present invention.
Figure 7:
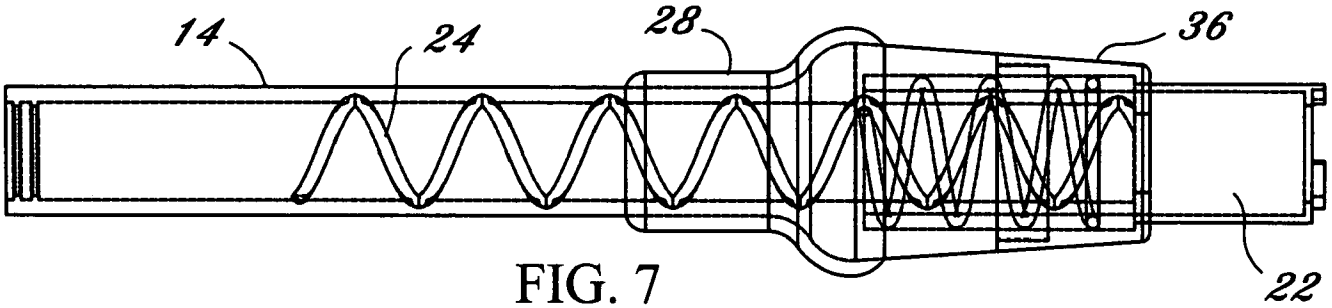
FIG. 7 is a partial cross-sectional view of a body assembly of an orbital marking pencil according to the preferred embodiment of the present invention.
Figure 8:
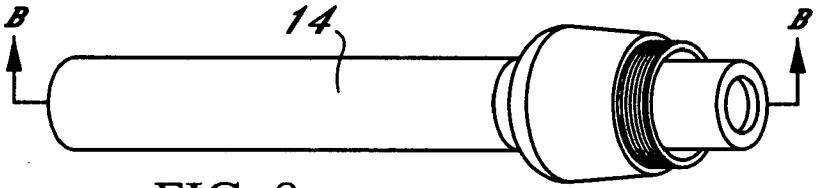
FIG. 8 is a side view of an outside body of an orbital marking pencil according to the preferred embodiment of the present invention.
Figure 9:
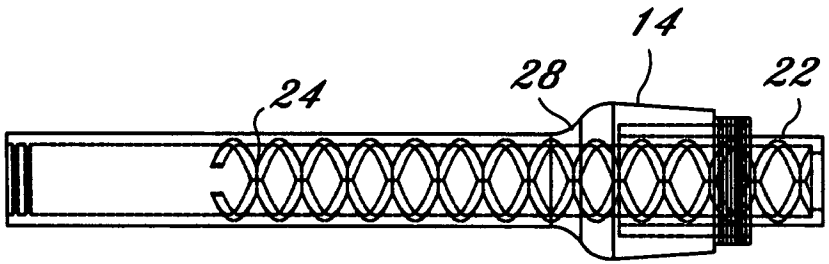
FIG. 9 is a cross-sectional view along line B—B of FIG. 8 of an orbital marking pencil according to the preferred embodiment of the present invention.

FIGS. 1–5 illustrate an orbital marking pencil 10 including a cap assembly 12, a body assembly 14, a rotator assembly 16, a main spring 18, a lead 20, a rotational support 22, a support spring 24, a rotator spring 26, a finger grip 28, a plunger 30, a marking collet 32, and at least a pair of lead gripping fingers 34. In the preferred embodiment of the present invention, pencil 10 is approximately 5.659 inches in length and 0.500 inches in diameter.

Figure 10:
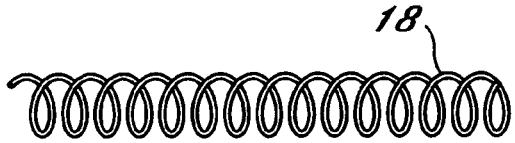
FIG. 10 is a perspective view of a main spring of an orbital marking pencil according to the preferred embodiment of the present invention.
Figure 11:
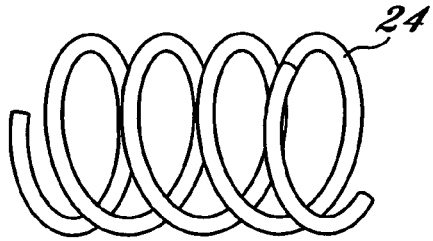
FIG. 11 is a perspective view of a support spring of an orbital marking pencil according to the preferred embodiment of the present invention.

FIGS. 6–9 illustrate body assembly 14 including finger grip 28, support spring 24, rotational support 22, and a screw cap 36. FIG. 10 illustrates main spring 18, and FIG. 11 illustrates support spring 24. In the preferred embodiment of the present invention, main spring 18 is 4 inches in free length and 2.75 inches compressed. The outer diameter of spring 18 is 0.370 inches with an inner diameter of 0.300 inches. Support spring 24 is 1 inch in free length and 0.299 inches compressed. The outer diameter of support spring 24 is 0.600 inches with an inner diameter of 0.480 inches. Furthermore, pencil 10 is approximately 5.659 inches in length.

Figure 12:
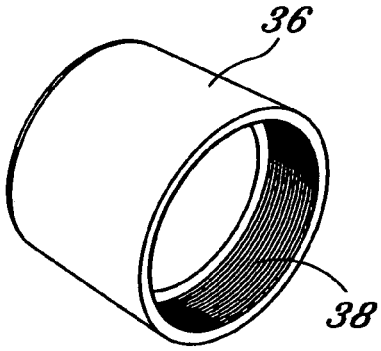
FIG. 12 is a perspective view of a screw cap of an orbital marking pencil according to the preferred embodiment of the present invention.
Figure 13:
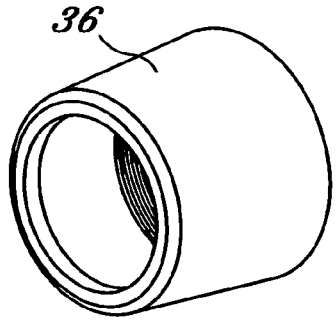
FIG. 13 is another perspective view of a screw cap of an orbital marking pencil according to the preferred embodiment of the present invention.
Figure 14:
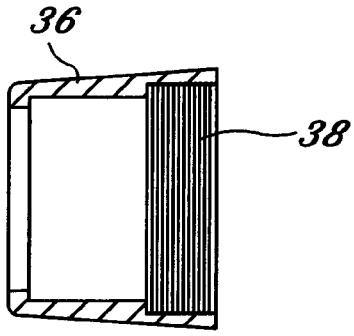
FIG. 14 is a side view of a screw cap of an orbital marking pencil according to the preferred embodiment of the present invention.
Figure 15:
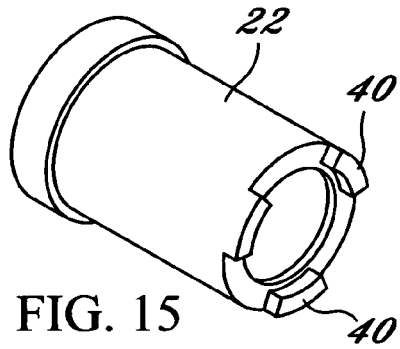
FIG. 15 is a perspective view of a support member of an orbital marking pencil according to the preferred embodiment of the present invention.

FIGS. 12–14 illustrate screw cap 36 of body assembly 14. Cap 36 includes a thread 38 that is approximately 11/16 inches. FIG. 15 illustrates rotational support 22 that is approximately 0.888 inches in length and 0.540 inches in diameter. In the preferred embodiment of the present invention, rotational support 22 is retained on body 14 with a snap ring (not shown). Support 22 preferably includes a least three projection feet 40. Rotational support 22 is fabricated from see-through or clear material to facilitate locating orbital marking pencil 10 directly over a score space.

Figure 16:
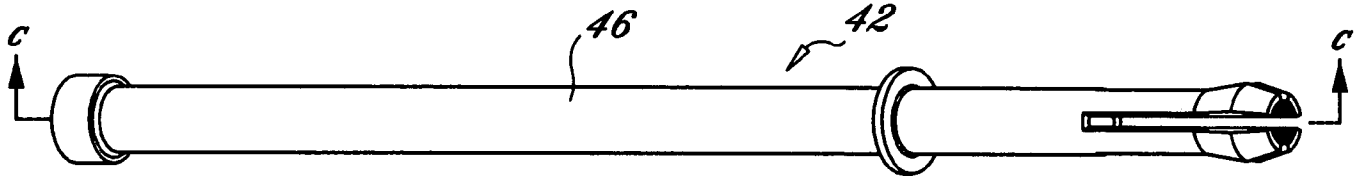
FIG. 16 is a perspective view of a lead gripper of an orbital marking pencil according to the preferred embodiment of the present invention.
Figure 17:
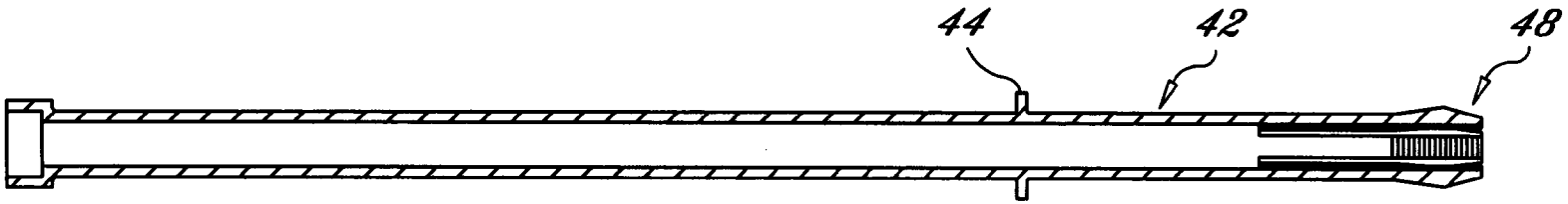
FIG. 17 is a cross-sectional view along line C—C of FIG. 16 of an orbital marking pencil according to the preferred embodiment of the present invention.
Figure 18:
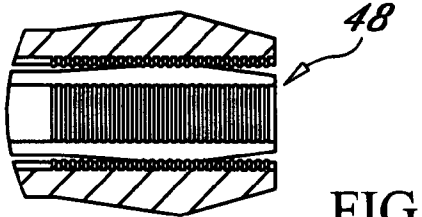
FIG. 18 is a view of a tip of a lead gripper of an orbital marking pencil according to the preferred embodiment of the present invention.

FIGS. 16–18 illustrate a lead gripper 42 having a protrusion 44 formed on an outside surface 46. A tip 48 of gripper 42 forms collet 32 that is configured to firmly retain lead 20. Serrations may be formed on an inside diameter of gripping fingers 34 to aid in the retention of lead 20. Lead 20 is inserted into collet 32 by depressing plunger 30 and inserting lead 20 directly into gripper 42. More than one piece of lead may be inserted into collet 32.

Figure 19:
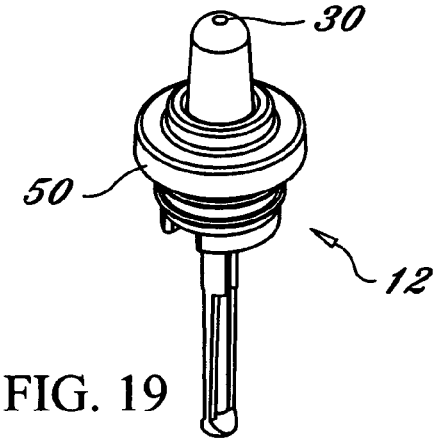
FIG. 19 is a perspective view of a cap assembly of an orbital marking pencil according to the preferred embodiment of the present invention.
Figure 20:
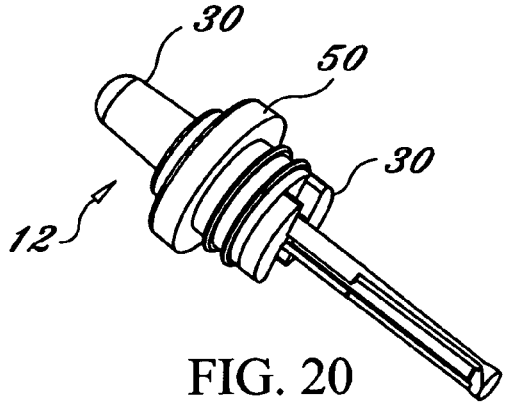
FIG. 20 is another perspective view of a cap assembly of an orbital marking pencil according to the preferred embodiment of the present invention.
Figure 21:
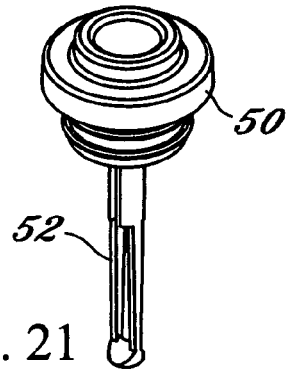
FIG. 21 is a perspective view of an end cap of an orbital marking pencil according to the preferred embodiment of the present invention.
Figure 22:
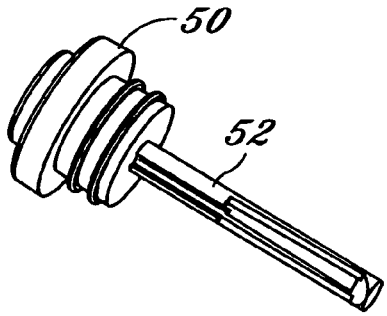
FIG. 22 is another perspective view of an end cap of an orbital marking pencil according to the preferred embodiment of the present invention.
Figure 23A:
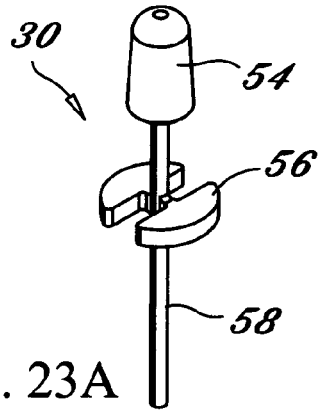
FIG. 23A is a perspective view of a plunger of an orbital marking pencil according to the preferred embodiment of the present invention.
Figure 23B:
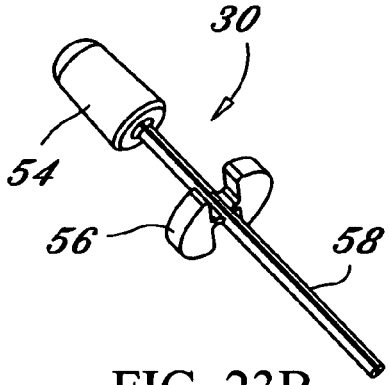
FIG. 23B is another perspective view of a plunger of an orbital marking pencil according to the preferred embodiment of the present invention.

FIGS. 19–20 illustrate cap assembly 12 including an end cap 50 and plunger 30. FIGS. 21–22 illustrate end cap 50 including leg 52 that is approximately 0.813 inches. In the preferred embodiment of the present invention, end cap 50 is approximately 0.498 inches in diameter and 0.358 inches in length. FIGS. 23A–23B further illustrate plunger 30 including cap portion 54, disk 56 and elongated portion 58. Plunger 30 is approximately 1.408 includes in length and cap portion 54 is approximately 0.338 inches long.

Figure 24:
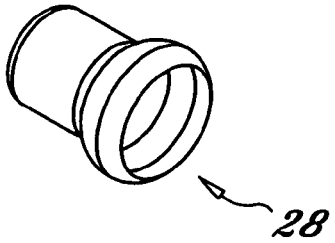
FIG. 24 is a perspective view of a finger grip of an orbital marking pencil according to the preferred embodiment of the present invention.
Figure 25:
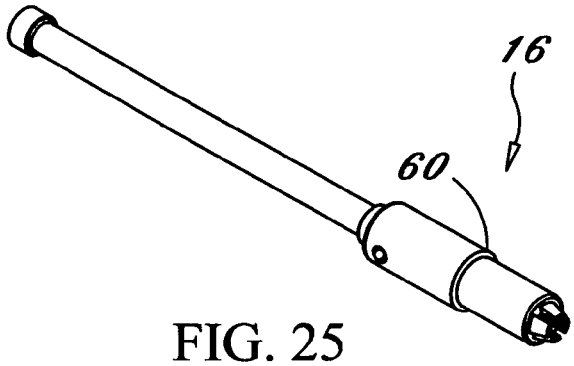
FIG. 25 is a perspective view of a rotator assembly of an orbital marking pencil according to the preferred embodiment of the present invention.
Figure 26:
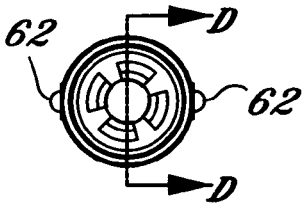
FIG. 26 is an end view of a rotator assembly of an orbital marking pencil according to the preferred embodiment of the present invention.
Figure 30:
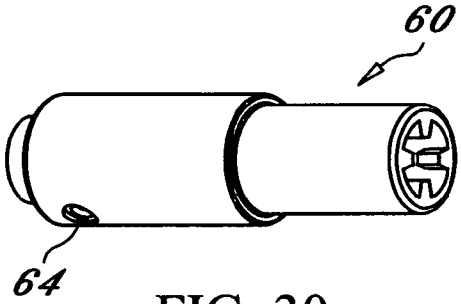
FIG. 30 is a perspective view of a rotator of an orbital marking pencil according to the preferred embodiment of the present invention.
Figure 31:
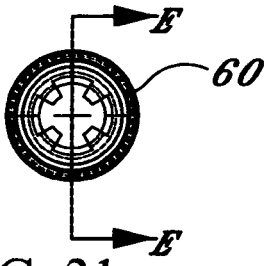
FIG. 31 is an end view of a rotator of an orbital marking pencil according to the preferred embodiment of the present invention.
Figure 32:
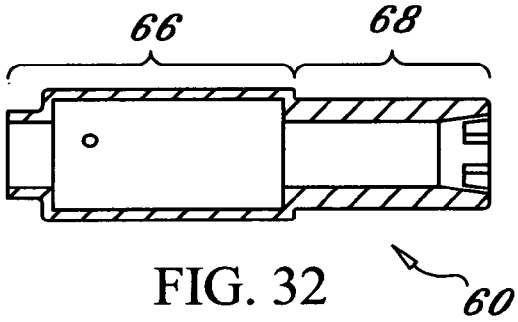
FIG. 32 is a cross-sectional view along line E—E of FIG. 31 of an orbital marking pencil according to the preferred embodiment of the present invention.
Figure 33:
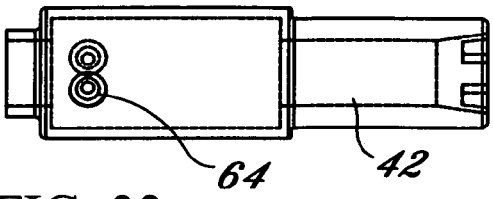
FIG. 33 is a cross-sectional view of a rotator of an orbital marking pencil according to the preferred embodiment of the present invention.

FIG. 24 illustrates finger grip 28 of body assembly 14.

Figure 34:
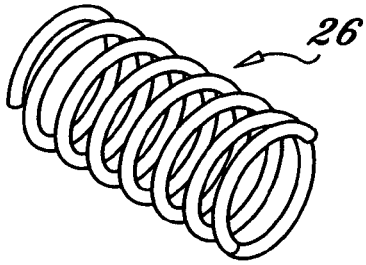
FIG. 34 is a perspective view of a rotator spring of an orbital marking pencil according to the preferred embodiment of the present invention.
Figure 27:
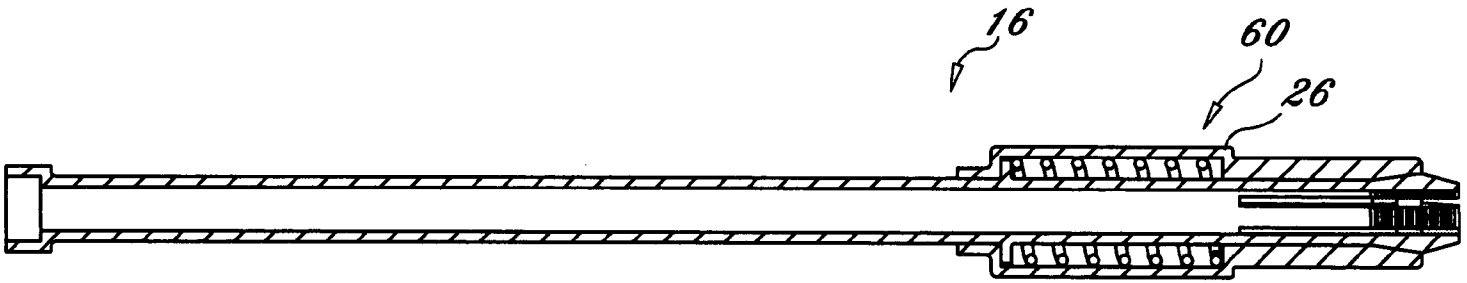
FIG. 27 is a cross-sectional view along line D—D of FIG. 26 of an orbital marking pencil according to the preferred embodiment of the present invention.
Figure 28:
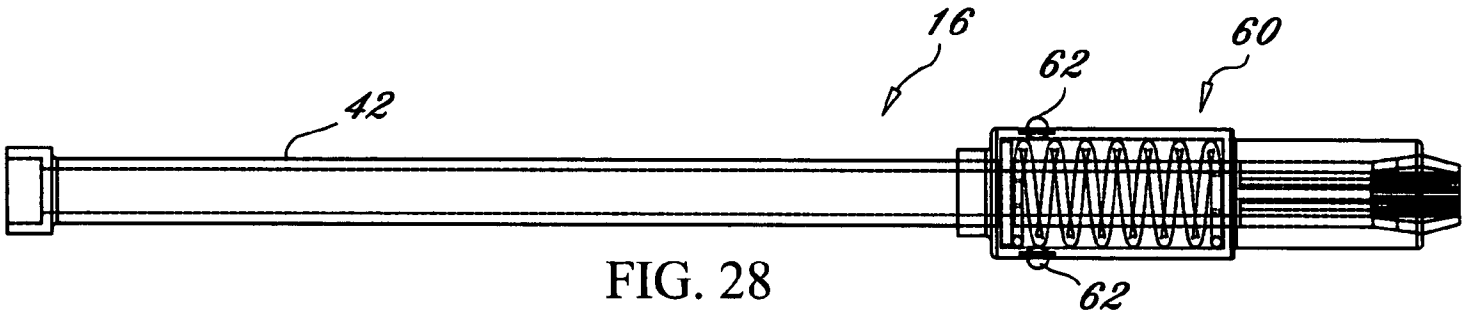
FIG. 28 is a cross-sectional view of a rotator assembly of an orbital marking pencil according to the preferred embodiment of the present invention.
Figure 29:
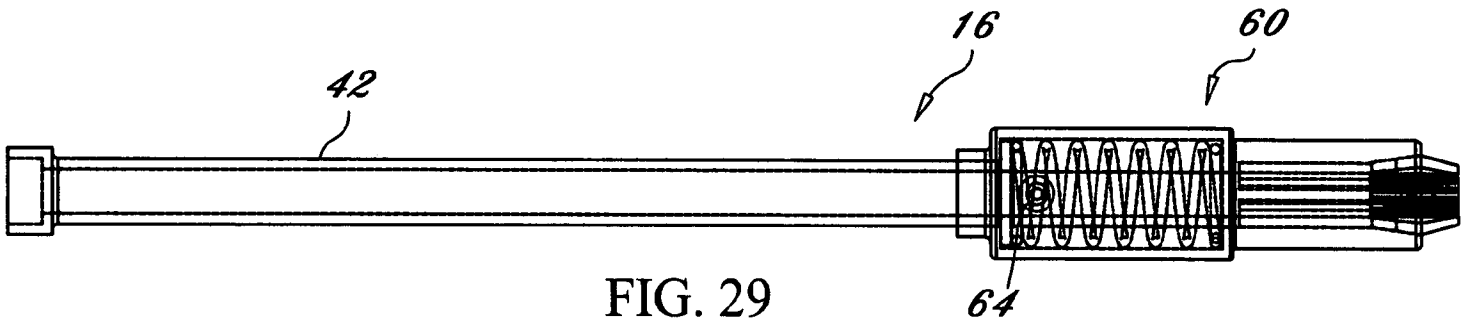
FIG. 29 is another cross-sectional view of a rotator assembly of an orbital marking pencil according to the preferred embodiment of the present invention.

FIGS. 25–29 illustrate rotator assembly 16, FIGS. 30–33 illustrate a rotator 60, and FIG. 34 illustrates rotator spring 26. Assembly 16 includes a pair of ball bearings 62 and corresponding bearing press washer 64. Rotator assembly 16 is approximately 4.188 inches in length and rotator 60 is approximately 1.337 inches in length with a first portion 66 that is approximately 0.639 inches in length and a second portion 68 that is approximately 0.572 inches in length. Ball bearings 62 are located opposite one another in first portion 66 and rotate within a convoluted race 68 (FIG. 4) in body assembly 14. Convoluted race 68 is formed in body assembly 14 and is a double helix ½ inch pitch that is 3 inches in length. Rotator spring 26 is approximately 0.710 inches in free length and 0.310 inches compressed, with an outer diameter of 0.306 inches and an inner diameter of 0.190 inches.

To score a space, lead 20 is preferably placed directly over a score space using rotational support 22 as a guide for sliding orbital marking pencil 10 over a score sheet. Rotational support 22 also maintains pencil 10 in a vertical position. Pencil 10 may, however, also be used without the aid of rotational support 22.

As discussed above, pencil 10 includes main spring 18 body assembly 14 and support spring 24 and rotator spring 26 in the forward tip of orbital pencil 10. Main spring 18 provides resistance for and returns rotator assembly 16 back into position. Rotator spring 26 provides resistance for and returns plunger 30 back into position. When plunger 30 is pressed, rotator spring 26 is actuated. Rotator spring 26 opens collet 32 which retains lead 20. Support spring 24 is also located in the forward tip of orbital pencil 10 and provides resistance to keep rotational support 22 in position and to return support 22 to a starting position after pencil 10 has been actuated.

As a user pushes body assembly 14 downward from a vertical position, ball bearings 62 (FIG. 26) seated in inner convoluted race 68 (FIG. 4) of body assembly 14 are actuated, thereby rotating lead 20 in an orbital motion to create the mark. Lead 20 is then returned to a starting position by support spring 22.

Orbital Eraser and Scratch-Off Card Remover

Figure 35:
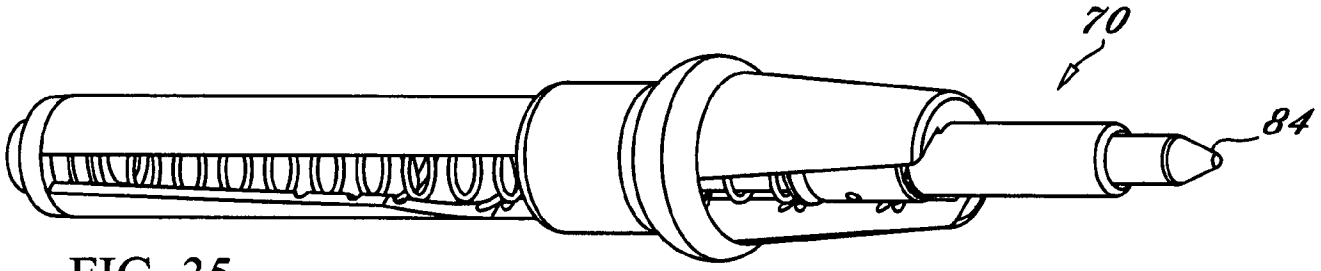
FIG. 35 is a perspective view of an orbital eraser and scratch-off card remover according to the preferred embodiment of the present invention.
Figure 36:
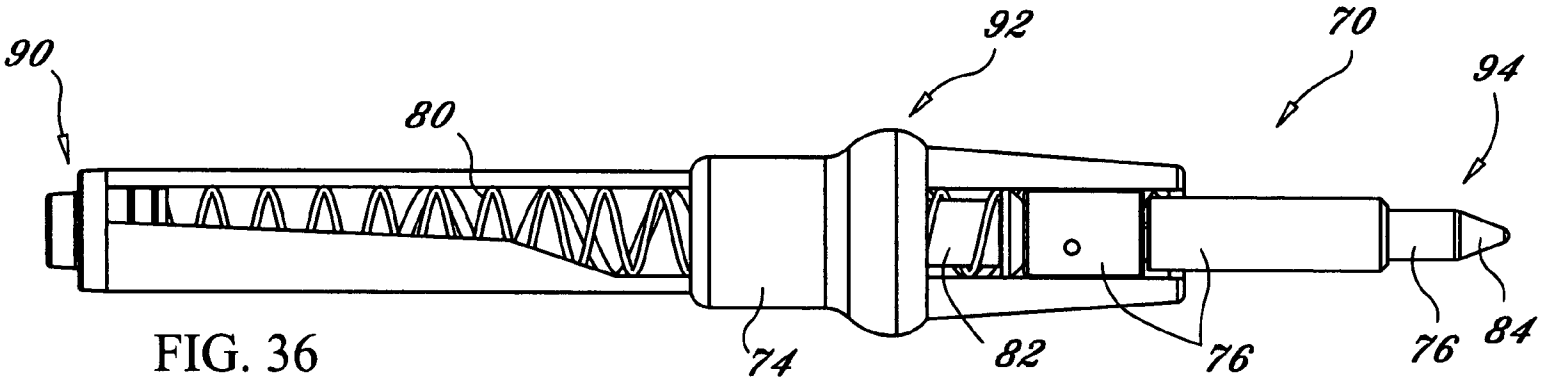
FIG. 36 is a partial cross-sectional view of an orbital eraser and scratch-off card remover according to the preferred embodiment of the present invention.
Figure 37:
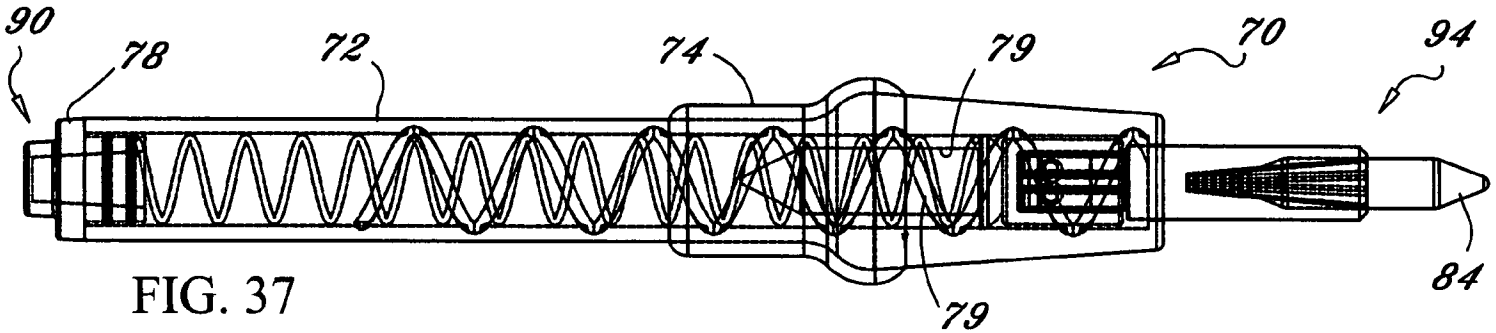
FIG. 37 is a cross-sectional view of an orbital eraser and scratch-off card remover according to the preferred embodiment of the present invention.
Figure 38:
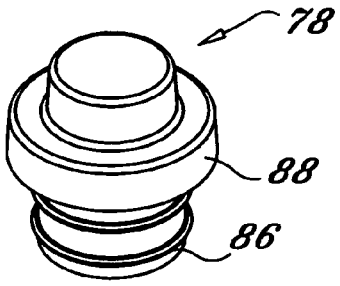
FIG. 38 is a perspective view of an end cap of an orbital eraser and scratch-off card remover according to the preferred embodiment of the present invention.
Figure 39:
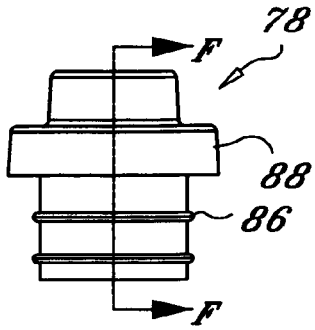
FIG. 39 is a side view of an end cap of an orbital eraser and scratch-off card remover according to the preferred embodiment of the present invention.
Figure 40:
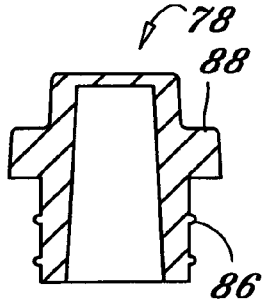
FIG. 40 is a cross-sectional view along line F—F of FIG. 39 of an orbital eraser and scratch-off card remover according to the preferred embodiment of the present invention.
Figure 41:
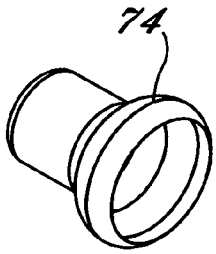
FIG. 41 is a perspective view of a finger grip of an orbital eraser and scratch-off card remover according to the preferred embodiment of the present invention.
Figure 42:
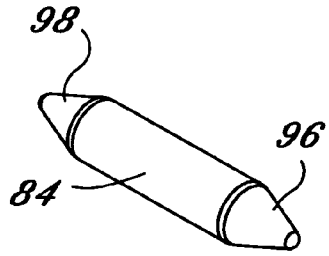
FIG. 42 is a perspective view of a foam/felt tip of an orbital eraser and scratch-off card remover according to the preferred embodiment of the present invention.

FIGS. 35–37 illustrate an orbital eraser and scratch-off card remover 70 that includes a body assembly 72, a finger grip 74, a drive assembly 76, an end cap 78, a main spring 80, a spring pivot 82, and a foam/felt tip 84. Remover 70 is approximately 6.103 inches in length.

End cap 78 includes a threaded portion 86 and cap protrusion 88. Cap 78 is approximately 0.501 inches in length and is received in a first end 90 of remover 70. Finger grip 74 is located in a middle portion 92 of remover 70, and is approximately 0.987 inches in length. Main spring 80 is approximately 4.00 inches in free length and 2.75 inches compressed. As illustrated above in orbital marking pencil 10, a pair of ball bearings 77 are received in a convoluted race 79 formed in body assembly 72. Ball bearings 77 are approximately 0.060 inches in diameter. Convoluted race 79 is formed in body assembly 72 and is a double helix ½ inch pitch that is 3 inches in length.

Foam/felt tip 84 is approximately 1.060 inches in length and is located at a second end 94 of remover 70. Tip 84 includes a first end 96 and a second end 98. In the preferred embodiment of the present invention, tip 84 is a foam tip manufactured from special grade foam. Tip 84 may also be manufactured from felt or any other equivalent material known by one of ordinary skill in the art.

Figure 43:
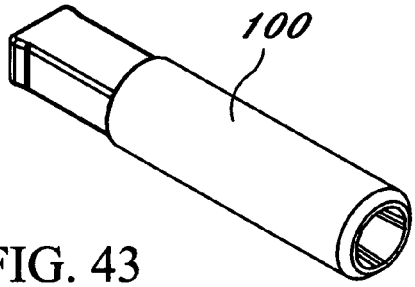
FIG. 43 is a perspective view of a foam/felt tip holder of an orbital eraser and scratch-off card remover according to the preferred embodiment of the present invention.
Figure 44:
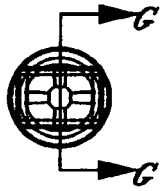
FIG. 44 is an end view of a foam/felt tip holder of an orbital eraser and scratch-off card remover according to the preferred embodiment of the present invention.
Figure 45:
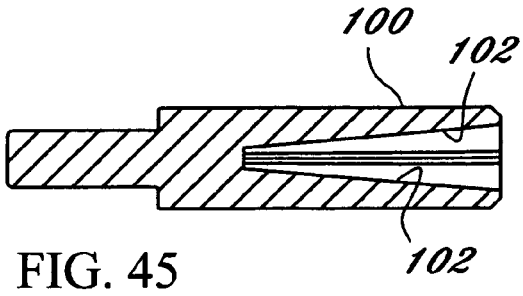
FIG. 45 is a cross-section view along line G—G of FIG. 44 of an orbital eraser and scratch-off card remover according to the preferred embodiment of the present invention.
Figure 46:
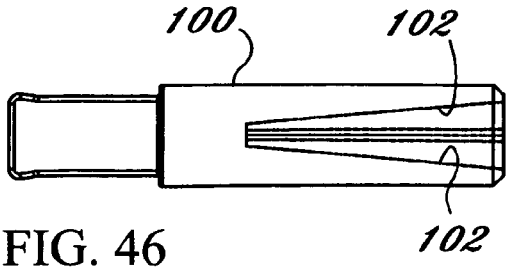
FIG. 46 is a side view of a foam/felt tip holder of an orbital eraser and scratch-off card remover according to the preferred embodiment of the present invention.

FIG. 43 illustrates a foam/felt tip holder 100 configured to retain tip 84. Holder 100 is approximately 1.443 inches in length. A tapered cavity 102 receives end 98 of tip 84.

Figure 47:
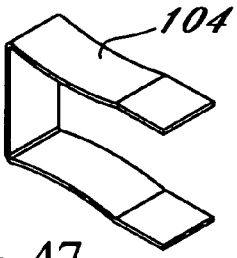
FIG. 47 is a perspective view of a bearing spring of an orbital eraser and scratch-off card remover according to the preferred embodiment of the present invention.
Figure 48:
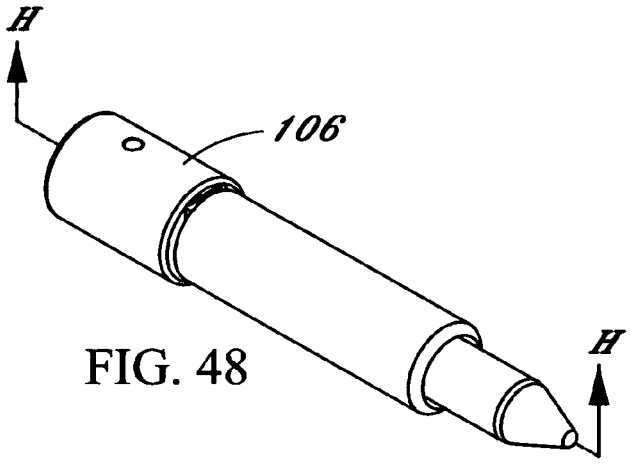
FIG. 48 is a perspective view of a foam/felt tip drive assembly of an orbital eraser and scratch-off card remover according to the preferred embodiment of the present invention.
Figure 51:
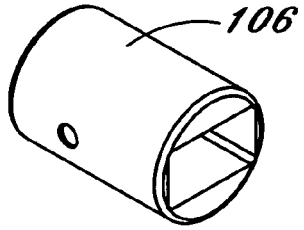
FIG. 51 is a perspective view of a bearing guide of an orbital eraser and scratch-off card remover according to the preferred embodiment of the present invention.
Figure 52:
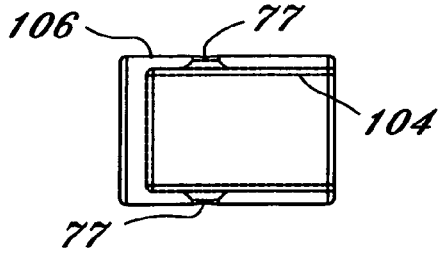
FIG. 52 is a cross-sectional view of a bearing guide of an orbital eraser and scratch-off card remover according to the preferred embodiment of the present invention.
Figure 53:
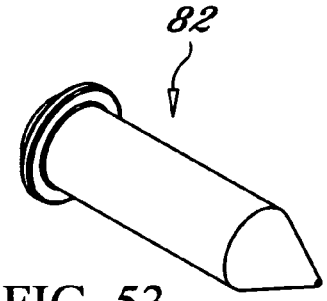
FIG. 53 is a perspective view of a spring pivot of an orbital eraser and scratch-off card remover according to the preferred embodiment of the present invention.
Figure 54:
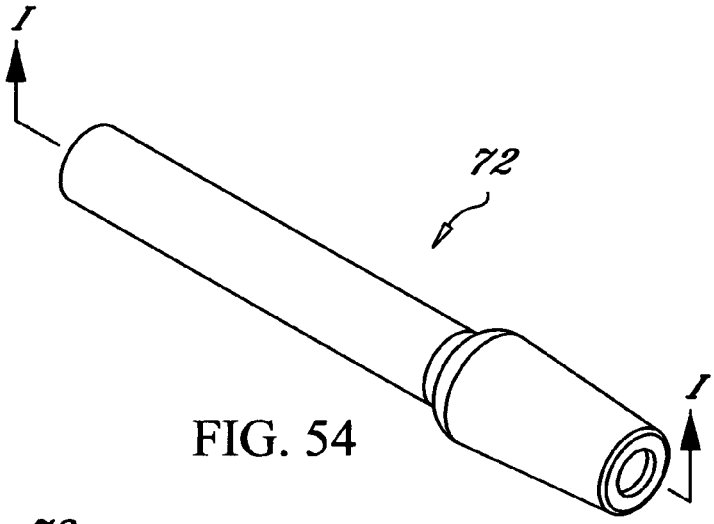
FIG. 54 is a perspective view of a body assembly of an orbital eraser and scratch-off card remover according to the preferred embodiment of the present invention.
Figure 55:
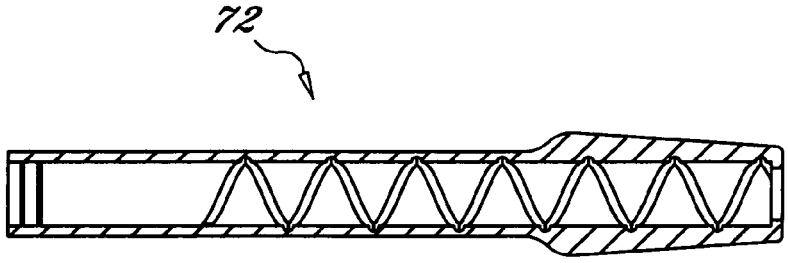
FIG. 55 is a cross-sectional view along line I—I of FIG. 54 of an orbital eraser and scratch-off card remover according to the preferred embodiment of the present invention.
Figure 56:
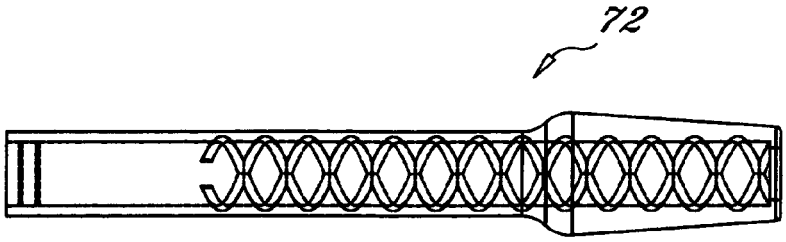
FIG. 56 is a cross-sectional view of an orbital eraser and scratch-off card remover according to the preferred embodiment of the present invention.

FIG. 47 illustrates a bearing spring 104 that is approximately 0.438 inches in length. Spring 104 is housed within a bearing guide 106 (FIG. 51). FIG. 53 illustrates a spring pivot 82 located in middle portion 92 of remover 70.

Similar in operation to the orbital marking pencil 10, orbital remover 70 removes the surface of a scratch-off lottery game card and can also erase lead and/or ink marks. Remover 70 is approximately 6.103 inches in length and 0.620 inches in diameter. This width allows for easy gripping and control. A user grasps finger grip 74 and pushes vertically downward on body assembly 72 to provide orbital rotation of tip 84 to remove a surface or mark.

The user holds remover 70 in a vertical position and places it over the surface to be removed. If pressed once, remover 70 accurately removes a predefined orbital surface area. If the user repeatedly presses down remover 70, a larger surface area will be removed.

Figure 49:
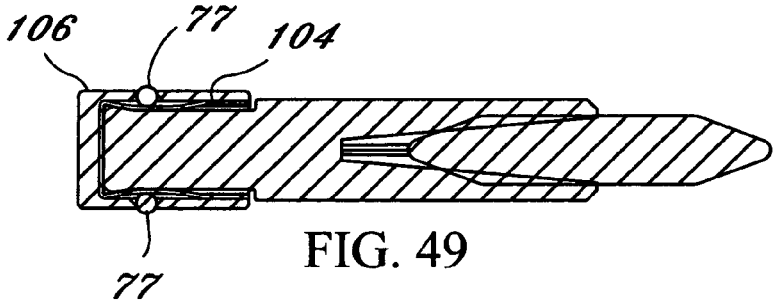
FIG. 49 is a cross-sectional view along line H—H of FIG. 48 of an orbital eraser and scratch-off card remover according to the preferred embodiment of the present invention.
Figure 50:
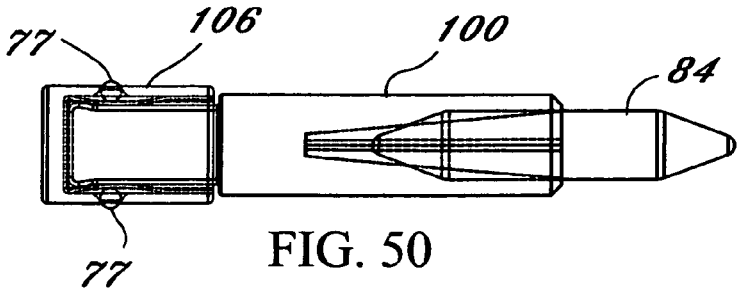
FIG. 50 is a cross-sectional view of a foam/felt tip drive assembly of an orbital eraser and scratch-off card remover according to the preferred embodiment of the present invention.

As illustrated above, remover includes main spring 80. Similar to the operation of marking pencil 10 described above, a user vertically pushes remover 70 to actuate ball bearings 77 housed within convoluted race 79 formed in body assembly 72. Ball bearings 77 are contained within race 79 between bearing spring 104 and bearing guide 106 (FIG. 49), thereby creating revolution of foam/felt tip 84 that is returned to a starting position by main spring 80.

Foam/felt tip holder 100 encapsulates remover tip 84. In the preferred embodiment of the present invention, tip 84 is tapered at a 42° angle.

Many changes and modifications may be made to the invention without departing from the spirit thereof. The scope of some of these changes has already been discussed in relation to the orbital pencil 10. For example, orbital marking pencil 10 may be combined into one single unit with orbital remover 70. The scope of other changes will become apparent from the attached claims.

What is claimed is:

1. An orbital remover comprising:

a body assembly including a main spring;

a tip drive assembly including a tip holder, a bearing guide having a convoluted race formed on an inner surface of the body assembly, a bearing spring, and at least two ball bearings, wherein the ball bearings are housed in the tip drive assembly between the bearing spring and the bearing guide within the convoluted race formed in the body assembly, and the depression of the body assembly in a vertical movement actuates the ball bearings within the convoluted race, thereby rotating a tip received in the tip holder in an orbital movement; and wherein the main spring provides resistance for and returns the tip drive assembly to a starting position after the body assembly is vertically depressed.

2. An orbital remover according to claim 1, further comprising a finger grip.

3. An orbital remover according to claim 1, wherein the body assembly is repeatedly depressed to erase more surface area by additional rotations of the tip when the ball bearings are actuated within the convoluted race.

4. An orbital remover comprising:

a body assembly including a main spring;

a tip drive assembly including a tip holder, a bearing guide having a convoluted race formed on an inner surface of the body assembly, a bearing spring, and at least two ball bearings, wherein the ball bearings are housed in the tip drive assembly between the bearing spring and the bearing guide within the convoluted race formed in the body assembly, and the depression of the body assembly in a vertical movement actuates the ball bearings within the convoluted race, thereby rotating a tip received in the tip holder in an orbital movement.

5. An orbital remover according to claim 4, further comprising a finger grip.

6. An orbital remover according to claim 5, wherein the body assembly is repeatedly depressed to erase more surface area by additional rotations of the tip when the ball bearings are actuated within the convoluted race.

7. An orbital remover according to claim 4, wherein the tip is manufactured from foam.

8. An orbital remover according to claim 4, wherein the tip is manufactured from felt.

* * * * *